US010347992B2

(12) United States Patent
Kim

(10) Patent No.: US 10,347,992 B2
(45) Date of Patent: Jul. 9, 2019

(54) ANTENNA AND VEHICLE HAVING THE ANTENNA

(71) Applicant: HYUNDAI MOTOR COMPANY, Seoul (KR)

(72) Inventor: Dongjin Kim, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 286 days.

(21) Appl. No.: 15/163,577

(22) Filed: May 24, 2016

(65) Prior Publication Data

US 2017/0141476 A1 May 18, 2017

(30) Foreign Application Priority Data

Nov. 13, 2015 (KR) ..... 10-2015-0159909

(51) Int. Cl.

| | |
|---|---|
| ***H01Q 13/10*** | (2006.01) |
| ***H01Q 21/00*** | (2006.01) |
| ***H01Q 1/32*** | (2006.01) |
| ***H01Q 13/18*** | (2006.01) |

(52) U.S. Cl.

CPC ..... *H01Q 13/18* (2013.01); *H01Q 1/32* (2013.01); *H01Q 1/3275* (2013.01); *H01Q 21/0056* (2013.01)

(58) Field of Classification Search

CPC ..... H01Q 1/24; H01Q 1/241; H01Q 1/245; H01Q 1/246; H01Q 1/27; H01Q 1/32; H01Q 1/3275; H01Q 1/36; H01Q 3/24; H01Q 3/242; H01Q 3/2617; H01Q 13/18; H01Q 21/0031; H01Q 21/0043; H01Q 21/005; H01Q 21/0056; H01Q 21/0062; H01Q 21/20; H01Q 21/205; H01Q 13/10; H01Q 13/12; H01Q 13/22; H01Q 15/04;

(Continued)

(56) References Cited

U.S. PATENT DOCUMENTS

| | | | |
|---|---|---|---|
| 6,124,833 A | 9/2000 | Bialkowski et al. | |
| 6,933,900 B2 * | 8/2005 | Kitamori ..... | H01Q 1/3233 343/713 |

(Continued)

FOREIGN PATENT DOCUMENTS

| | | |
|---|---|---|
| JP | H08213820 A | 8/1996 |
| JP | 2008-166856 A | 7/2008 |
| KR | 10-2007-0072629 A | 7/2007 |

(Continued)

OTHER PUBLICATIONS

English translation of Notice of Allowance dated Feb. 13, 2017 issued in Korean Patent Application No. 10-2015-0159909.

*Primary Examiner* — Daniel Munoz
*Assistant Examiner* — Patrick R Holecek
(74) *Attorney, Agent, or Firm* — Morgan Lewis & Bockius LLP

(57) ABSTRACT

An antenna includes an upper plate having a fan shape, a lower plate having a shape corresponding to the upper plate, a feeding unit disposed at a center of the fan shape, at least one waveguide formed between the upper plate and the lower plate for propagating signals supplied from the feeding unit, and at least one radiation slot formed in an arc of the fan shape for radiating the signals propagated by the at least one waveguide to the outside.

16 Claims, 18 Drawing Sheets

(58) Field of Classification Search
CPC ..... H01Q 15/14; H01Q 19/10; H01Q 19/138; H01Q 19/18; H01Q 19/185; H01Q 9/28
See application file for complete search history.

(56) References Cited

U.S. PATENT DOCUMENTS

| | | | | |
|---|---|---|---|---|
| 2009/0066597 | A1* | 3/2009 | Yang | H01P 3/121 343/771 |
| 2013/0234889 | A1* | 9/2013 | Hwang | H01Q 3/242 342/368 |

FOREIGN PATENT DOCUMENTS

| | | | |
|---|---|---|---|
| KR | 2008-0026720 | A | 3/2008 |
| KR | 10-2013-0098098 | A | 9/2013 |
| KR | 10-2014-0031047 | A | 3/2014 |

* cited by examiner

ANTENNA AND VEHICLE HAVING THE ANTENNA

CROSS-REFERENCE TO RELATED APPLICATION

This application claims the benefit of priority to Korean Patent Application No. 10-2015-0159909, filed on Nov. 13, 2015 with the Korean Intellectual Property Office, the disclosure of which is incorporated herein by reference.

TECHNICAL FIELD

Embodiments of the present disclosure relate to an antenna that is capable of transmitting and receiving radio wave signals in the millimeter band for fifth generation (5G) communication and a vehicle having the antenna.

BACKGROUND

An antenna used in 5G communication requires a structure having a low loss characteristic and a high directivity due to the losses in the millimeter band.

A microstrip patch array antenna, a box-shaped horn array antenna, and so on, have been used as a conventional antenna for use in the millimeter band. However, the microstrip patch array antenna has a high level of difficulty in transmitting signals having the same amplitude to each radiation slot and a high loss rate caused by the material. Also, the box-shaped horn array antenna has a complicated structure and is difficult to manufacture.

Thus, a development of an antenna capable of transmitting radio wave signals in the millimeter band with minimal losses and capable of being easily manufactured is necessary.

SUMMARY

Therefore, it is an aspect of the present disclosure to provide an antenna having a simple structure in which a feeding unit and a radiation unit are disposed in the same plane so that design for an additional feeding unit is not required, and a vehicle having the same.

It is another aspect of the present disclosure to provide an antenna that is capable of adjusting a radiation angle to allow easily changing a design of the antenna according to a use of the antenna and a vehicle having the same.

Additional aspects of the disclosure will be set forth in part in the description which follows and, in part, will be obvious from the description, or may be learned by a practice of the disclosure.

In accordance with one aspect of the present disclosure, an antenna includes: an upper plate having a fan shape; a lower plate having a shape corresponding to the upper plate; a feeding unit disposed in a center of the fan shape; at least one waveguide formed between the upper plate and the lower plate and propagating signals supplied from the feeding unit; and at least one radiation slot formed in an arc of the fan shape and radiating the signals propagated by the at least one waveguide to the outside.

The at least one waveguide may be partitioned by a plurality of partition walls disposed between the upper plate and the lower plate.

Each of the plurality of partition walls may have a plate shape.

The partition walls may be formed by a plurality of pins adjacently disposed at a critical distance or less.

The plurality of pins may be inserted into the upper plate and the lower plate.

A plurality of waveguides may be provided, and the plurality of waveguides may distribute signals supplied from the feeding unit with the same phase and the same amplitude.

The antenna may further include a plurality of inductive posts disposed at inlets of the plurality of waveguides to which the signals supplied from the feeding unit are input.

The upper plate and the lower plate may include printed circuit boards (PCBs).

The upper plate, the lower plate, and the partition walls may include at least one selected from the group consisting of metal such as copper, iron, aluminum, silver, nickel, and stainless steel.

Each of the plurality of partition walls may have the same angle formed by neighboring partition walls.

In accordance with another aspect of the present disclosure, a vehicle includes: at least one antenna; and a transceiver modulating signals to be supplied to the at least one antenna and demodulating the signals received by the at least one antenna, wherein the antenna includes: an upper plate having a fan shape; a lower plate having a shape corresponding to the upper plate; a feeding unit disposed in a center of the fan shape; at least one waveguide formed between the upper plate and the lower plate and propagating signals supplied from the feeding unit; and at least one radiation slot formed in an arc of the fan shape and radiating the signals propagated by the at least one waveguide to the outside.

The at least one waveguide may be partitioned by a plurality of partition walls disposed between the upper plate and the lower plate.

Each of the plurality of partition walls may have a plate shape, or the partition walls may be formed by a plurality of pins adjacently disposed at a critical distance or less.

The plurality of pins may be inserted into the upper plate and the lower plate.

A plurality of waveguides may be provided, and the plurality of waveguides may distribute signals supplied from the feeding unit with the same phase and the same amplitude.

The upper plate and the lower plate may include printed circuit boards (PCBs).

The upper plate, the lower plate, and the partition walls may include at least one selected from the group consisting of metal such as copper, iron, aluminum, silver, nickel, and stainless steel.

Each of the plurality of partition walls may have the same angle formed by neighboring partition walls.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
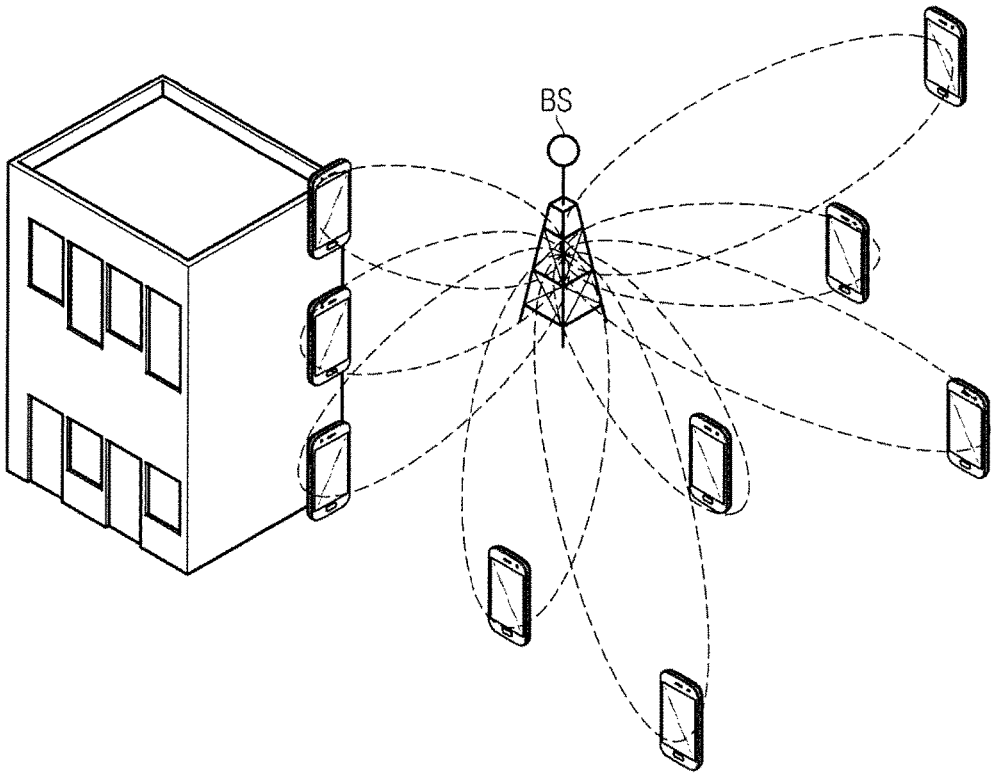
FIG. 1 is a view of a large-scale antenna system of a base station based on a fifth generation (5G) communication method.

Reference will now be made in detail to the embodiments of the present disclosure hereinafter, examples of which are illustrated in the accompanying drawings, wherein like reference numerals refer to like elements throughout.

An antenna in accordance with an embodiment of the present disclosure may be built in a vehicle and can transmit and receive radio wave signals so that the vehicle may perform a communication with an external terminal device, an external server or another vehicle.

The radio wave signals transmitted and received by the antenna in accordance with an embodiment of the present disclosure may be signals based on a second generation (2G) communication method, such as time division multiple access (TDMA) and code division multiple access (CDMA), a third generation (3D or 3G) communication method, such as wide code division multiple access (WCDMA), code division multiple access 2000 (CDMA2000), wireless broadband (Wibro), and world interoperability for microwave access (WiMAX), a fourth generation (4D or 4G) communication method, such as long term evolution (LTE) and wireless broadband (Wibro) evolution, or a fifth generation (5G) communication method.

Hereinafter, in an embodiment that will be described in detail, an antenna that transmits and receives radio wave signals based on the 5G communication method will be described.

Figure 2:
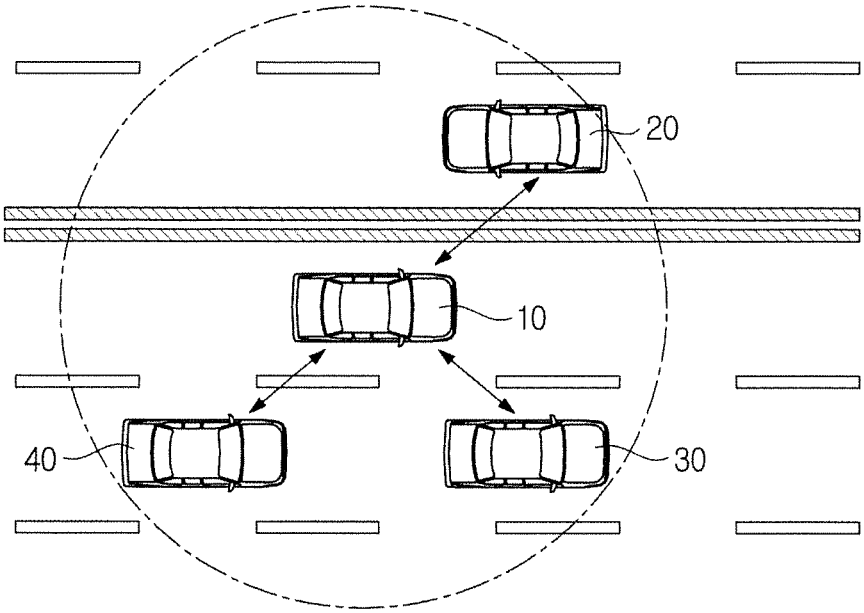
FIG. 2 is a view of a network based on a 5G communication method in accordance with an embodiment of the present disclosure.

FIG. 1 is a view of a large-scale antenna system of a base station based on a 5G communication method, and FIG. 2 is a view of a network based on the 5G communication method in accordance with an embodiment of the present disclosure.

A large-scale antenna system may be employed in the 5G communication method. The large-scale antenna system may mean a system in which more than several tens of antennas may be used and cover an ultrahigh band frequency and may transmit and receive large amounts of data through a simultaneous multiple access. In detail, the large-scale antenna system may adjust an arrangement of antenna elements and transmit and receive radio wave signals farther in a particular direction, so that a high-capacity transmission may be performed and an available region for a 5G communication network may be extended.

Referring to FIG. 1, a base station (BS) may simultaneously transmit and receive data with many devices via the large-scale antenna system. In addition, in the large-scale antenna system, radio wave signals to be output in a direction other than a direction in which the radio wave signals are transmitted may be minimized to reduce noise so that improvements in transmission quality and reductions in power may be achieved.

Also, in the 5G communication method, wireless signals modulated using a non-orthogonal multiplexing access (NOMA) method may be transmitted so that multiple access of more devices may be performed and large-capacity transmission/reception may be simultaneously performed, unlike in an existing communication method where transmission signals are modulated using an orthogonal frequency division multiplexing (OFDM) method.

For example, in the 5G communication method, a transmission speed of 1 Gbps (maximum) can be provided. In the 5G communication method, immersive communication requiring large-capacity transmission such as ultra high definition (UHD), three-dimensional (3D) or hologram may be supported through a large-capacity transmission. Thus, a user may transmit and receive more elaborate and immersive ultrahigh capacity data more quickly through the 5G communication method.

Also, in the 5G communication method, real-time processing of 1 ms or less (maximum response rate) may be achieved. Thus, in the 5G communication method, a real-time service with a response that is faster than the user recognition time may be supported.

For example, when a communication module that enables 5G communication is built in a vehicle, the vehicle itself may be a hub of communication that transmits and receives data. Thus, the vehicle that is capable of performing communication with an external device may receive sensor information from various devices even when the vehicle is being driven, may provide an autonomous driving system through a real-time processing and may provide various remote controls.

In addition, as illustrated in FIG. 2, a vehicle 10 may process sensor information with other vehicles 20, 30 and 40 that exist in the vicinity of the vehicle 10 through the 5G communication method in real-time, may provide information on collision occurrence possibility to the user in real-time, and may provide traffic situation information generated on a driving path in real-time.

In addition, the vehicle 10 may provide a big data service to passengers in the vehicle 10 through real-time processing and large-capacity transmission provided by 5G communication. For example, the vehicle 10 may analyze various web information and social network service (SNS) information and may provide pieces of customized information that are suitable for passengers' situations in the vehicle 10. In one example, the vehicle 10 may collect pieces of information regarding various restaurants and sightseeing locations that exist in the vicinity of the driving path through big data mining and may provide the pieces of information in real-time so that the passengers may immediately check the various pieces of information that exist in the vicinity of a region in which the vehicle 10 is driving.

Meanwhile, the network of 5G communication may subdivide a cell so that a high density network may be established and a large-capacity transmission may be supported. Here, the cell may mean a zone that is formed by subdividing a large region into small zones so that a frequency may be effectively used in mobile communication. In this case, a small-output base station may be installed in each cell so that communication between terminals may be supported. For example, the network of 5G communication subdivides the cell by reducing the size of the cell so that a two-stage structure of macro cell base station—distributed small base station —communication terminal may be formed.

In addition, in the network of 5G communication, a relay transmission of wireless signals may be performed using a multihop method. For example, the vehicle disposed in the network of the BS may perform the relay transmission of wireless signals transmitted from other vehicles or devices disposed outside the network of the BS to the BS. Thus, a region in which the 5G communication network is supported may be enlarged, and simultaneously, a problem of buffering that occurs when there are many users in the cell may be solved.

Meanwhile, in the 5G communication method, device-to-device (D2D) communication applied to a vehicle and a communication device may be performed. D2D communication means a communication in which devices transmit and receive wireless signals directly without passing through the base station. When D2D communication is used, the wireless signals are not required to be transmitted and received via the base station, and wireless signal transmission is directly performed between devices so that unnecessary energy may be reduced.

Hereinafter, a structure of an antenna that enables 5G communication of the vehicle will be described.

Figure 3:
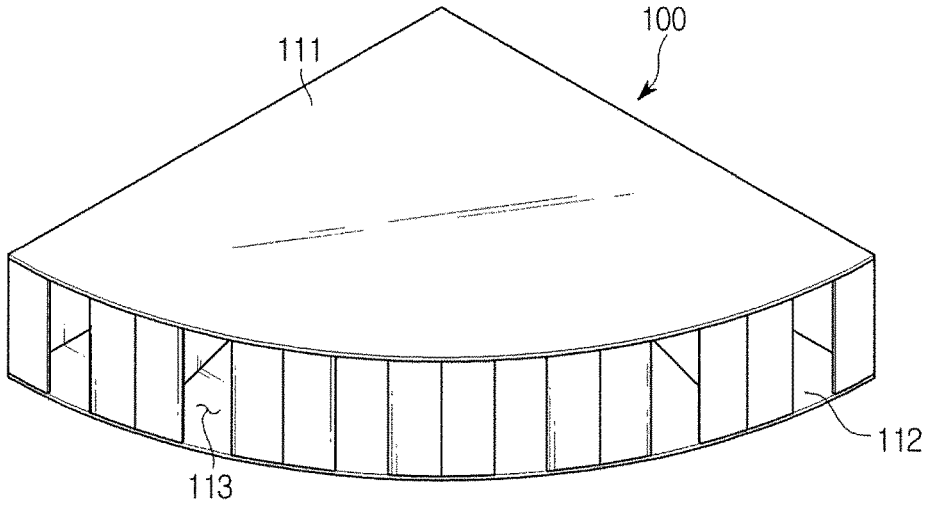
FIG. 3 is a perspective view illustrating an exterior of an antenna in accordance with an embodiment of the present disclosure.
Figure 4:
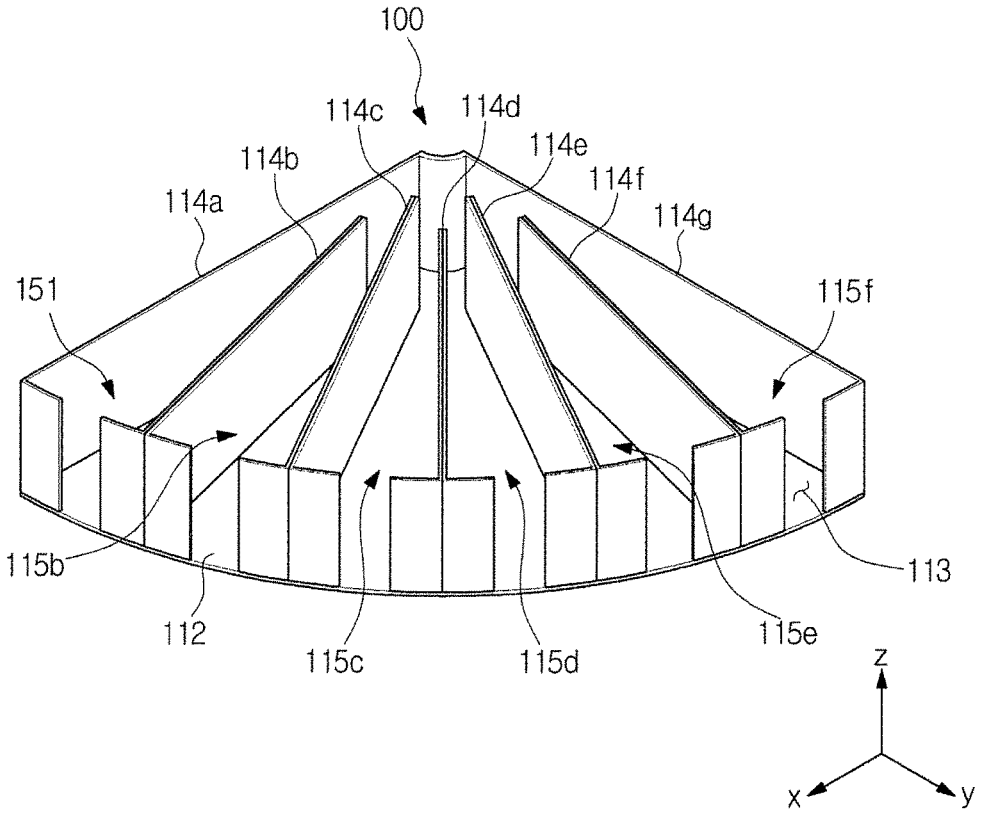
FIG. 4 is a perspective view illustrating an internal structure of an antenna in accordance with an embodiment of the present disclosure.
Figure 5:
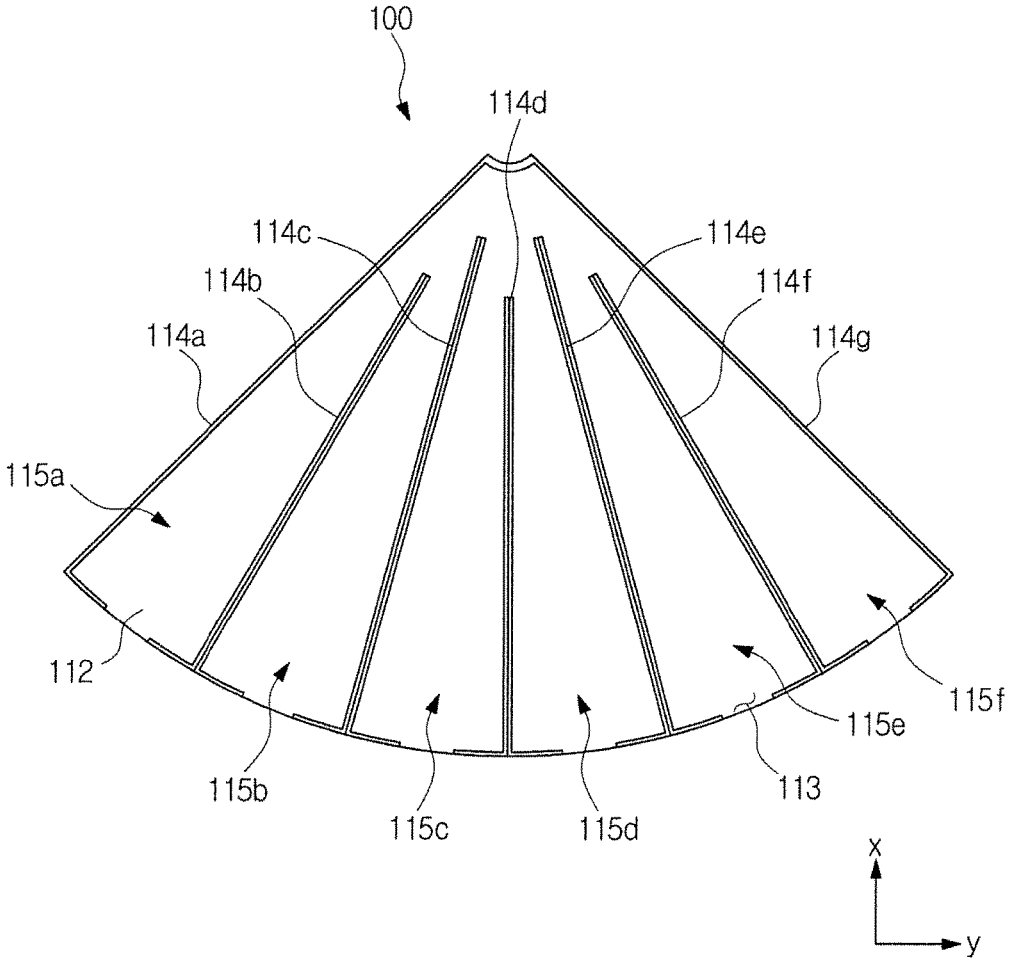
FIG. 5 is a plan view illustrating an internal structure of an antenna in accordance with an embodiment of the present disclosure.

FIG. 3 is a perspective view illustrating an exterior of an antenna in accordance with an embodiment of the present disclosure, and FIG. 4 is a perspective view illustrating an internal structure of an antenna in accordance with an embodiment of the present disclosure, and FIG. 5 is a plan view illustrating an internal structure of an antenna in accordance with an embodiment of the present disclosure.

As illustrated in FIGS. 3 through 5, an antenna 100 in accordance with an embodiment of the present disclosure may have a fan shape. The antenna 100 having the fan shape as will be described later may diverge radio wave signals fed from a center of the fan shape, i.e., a vertex, into many branches and may propagate the radio wave signals toward the arc of the fan shape, and by forming a plurality of radiation slots that correspond to each branch in a position corresponding to the arc of the fan shape, a sharp beam width may be obtained.

In addition, a central angle of the fan shape may be adjusted so that a desired radiation angle, i.e., desired coverage may be implemented, and the number of radiation slots may be adjusted so that a desired beam width may be implemented, that is, designing and making changes thereof may be easy.

Referring to FIG. 3, the antenna 100 may include an upper plate 111 and a lower plate 130 that form an exterior, and radio wave signals may be radiated into an outside free space through a plurality of radiation slots 113 formed between the upper plate 111 and the lower plate 130.

FIGS. 4 and 5 are views of an internal structure of an antenna 100 illustrated with the upper plate 111 omitted.

Referring to FIGS. 4 and 5, a plurality of waveguides 115:115*a*, 115*b*, 115*c*, 115*d*, 115*e*, and 115*f* are formed by partition walls 114: 114*a*, 114*b*, 114*c*, 114*d*, 114*e*, 114*f*, and 114*g* such that partition a space between an upper plate 111 and a lower plate 130.

In one example, when six waveguides are formed in the antenna 100, seven partition walls, i.e., first through seventh partition walls 114*a*, 114*b*, 114*c*, 114*d*, 114*e*, 114*f*, and 114*g* that partition the waveguides 115:115*a*, 115*b*, 115*c*, 115*d*, 115*e*, and 115 may be formed.

A first waveguide 115*a* may be formed by the first partition wall 114*a* and the second partition wall 114*b*, and a second waveguide 115*b* may be formed by the second partition wall 114*b* and the third partition wall 114*c*, and a third waveguide 115*c* may be formed by the third partition wall 114*c* and the fourth partition wall 114*d*. In addition, a fourth waveguide 115*d* may be formed by the fourth partition wall 114*d* and the fifth partition wall 114*e*, and a fifth waveguide 115*e* may be formed by the fifth partition wall 114*e* and the sixth partition wall 114*f*, and a sixth waveguide 115*f* may be formed by the sixth partition wall 114*f* and the seventh partition wall 114*g*.

The upper plate 111, the lower plate 112, and the partition walls 114 may be formed of a conductor. For example, the upper plate 111, the lower plate 112, and the partition walls 114 may be formed of a metal, such as copper, aluminum, iron, nickel, and silver, or an alloy thereof such as stainless steel. In this case, the antenna 100 may be easily formed using a technique such as 3D printing or casting.

Alternatively, the partition walls 114 each having a plate shape may be disposed between the upper plate 111 and the lower plate 112 that are implemented as a printed circuit board (PCB) substrate so that the antenna 100 may be formed.

In addition, a cavity between the upper plate 111 and the lower plate 112 may be filled with a dielectric. The dielectric may include air.

The waveguides 115 formed by a conductor may propagate radio wave signals, and the radio wave signals propagated through the waveguide 115 may be radiated into an outside free space through the radiation slots 113.

Figure 6:
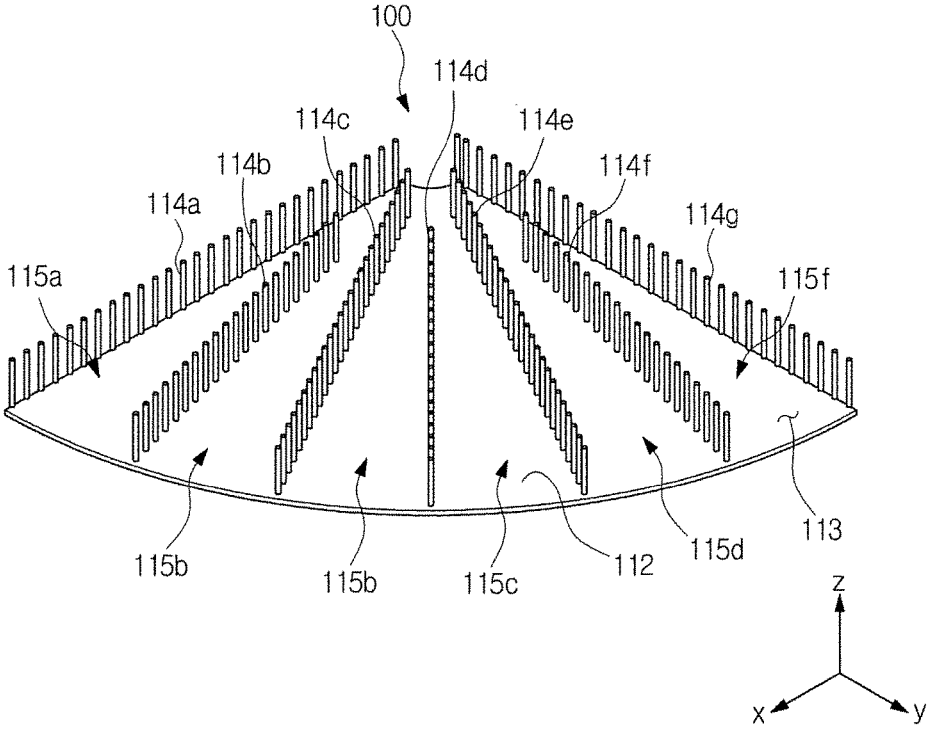
FIG. 6 is another perspective view illustrating an internal structure of an antenna in accordance with an embodiment of the present disclosure.

FIG. 6 is another perspective view illustrating an internal structure of an antenna in accordance with an embodiment of the present disclosure.

Referring to FIG. 6, the partition walls 114 that partition the waveguides 115 may also be implemented with a plurality of pins arranged at predetermined intervals. A distance between adjacent pins may be limited to a critical distance or less so that a loss of the radio wave signals that pass through the waveguides 115 may be prevented. In one example, the plurality of pins may be disposed at an interval that is less than 1/10 of the wavelength of the radio wave signals.

In the antenna 100 illustrated in FIG. 6, the upper plate 111 and the lower plate 112 may be implemented as a PCB substrate, and a plurality of metal pins may be inserted into the upper plate 111 and the lower plate 112 so that the partition walls 114 may be implemented. In this case, manufacturing and design difficulties may be reduced.

Even in this case, the cavity between the upper plate 111 and the lower plate 112 may be filled with a dielectric, and the dielectric may include air.

Figure 7:
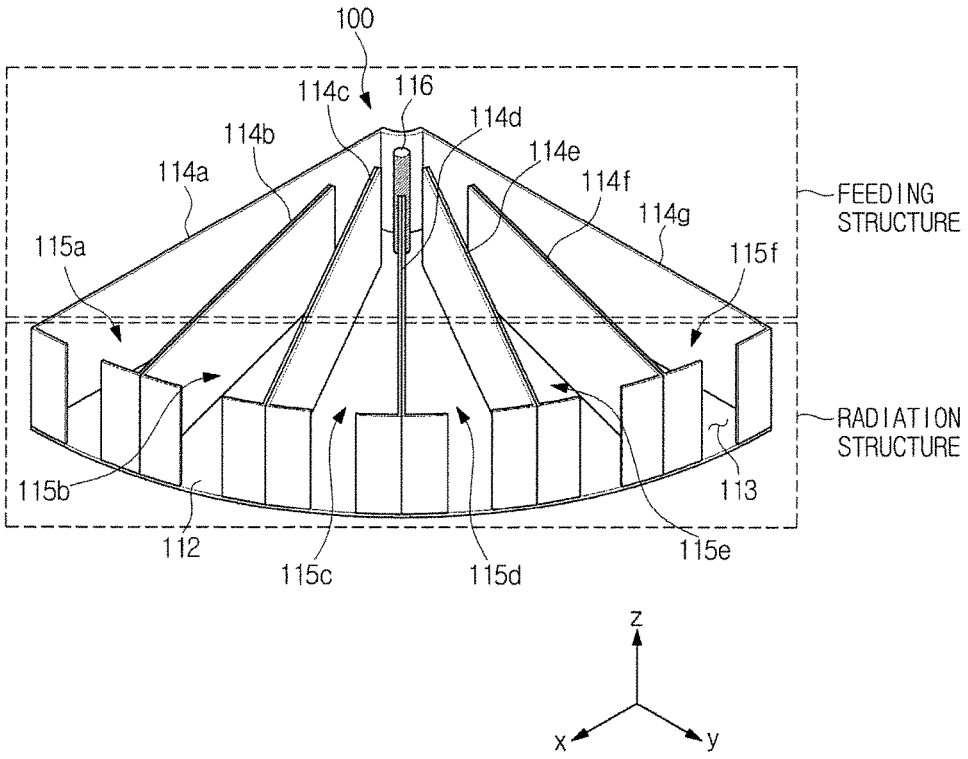
FIG. 7 is a view illustrating a feeding structure of an antenna in accordance with an embodiment of the present disclosure.
Figure 8:
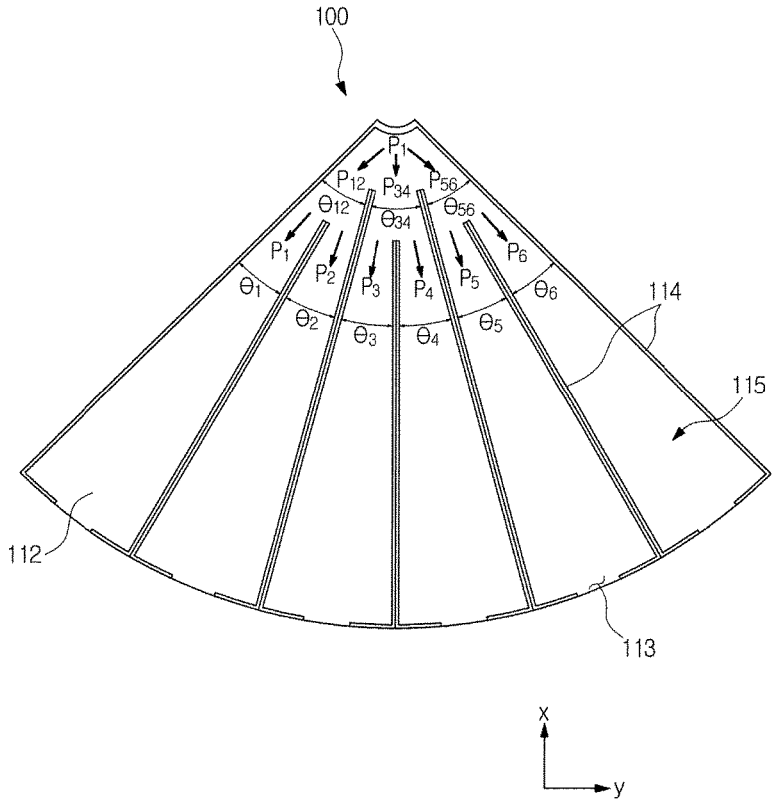
FIG. 8 is a view illustrating distribution of power supplied by a feeding unit.

FIG. 7 is a view illustrating a feeding structure of an antenna in accordance with an embodiment of the present disclosure, and FIG. 8 is a view illustrating distribution of power supplied by a feeding unit.

Referring to FIG. 7, a feeding unit 116 may be connected to an opposite side of the radiation slots 113, i.e., a center of the fan shape. For example, the feeding unit 116 may be implemented in a pin shape, and radio wave signals transmitted from an external transmitter may be transmitted to the antenna 100 through the feeding unit 116, and the radio wave signals received by the antenna 100 may be transmitted to an external receiver through the feeding unit 116.

The radio wave signals supplied from the feeding unit 116 may diverge into six waveguides 115*a*, 115*b*, 115*c*, 115*d*, 115*e* and 115*f*, and the diverged radio wave signals may propagate through the waveguides 115.

The radio wave signals may be radiated into an outside free space through the radiation slots 113*a*, 113*b*, 113*c*, 113*d*, 113*e* and 113*f* formed at an end of each waveguide.

Thus, in the antenna 100 in accordance with an embodiment of the present disclosure, since a feeding structure and a radiation structure are disposed in the same plane (xy-plane) and the feeding structure need not be separately designed, a low profile antenna may be implemented, and manufacturing thereof may be easy.

Meanwhile, when the radio wave signals fed from the feeding unit 116 diverge, power of the radio wave signals may be distributed. In the current example, a structure of the partition walls 114 may perform a function of a power distributor. Hereinafter, the divergence of the radio wave signals in terms of power distribution will be described with reference to FIG. 8.

As illustrated in FIG. 8, the length of the partition walls 114 that form each waveguide may be adjusted so that power supplied from the feeding unit 116 may be hierarchically distributed.

For example, as illustrated in FIG. 8, the length of the second partition wall 114*b* that is a boundary between the first waveguide 115*a* and the second waveguide 115*b*, the length of the fourth partition wall 114*d* that is a boundary between the third waveguide 115*c* and the fourth waveguide 115*d*, and the length of the sixth partition wall 114*f* that is a boundary between the fifth waveguide 115*e* and the sixth waveguide 115*f* may be implemented to be shorter than those of the remaining partition walls. The length of a partition wall may mean the length from an end of a partition wall adjacent to the feeding unit 116 to an opposite end and the length of the antenna 100 having the fan shape in a radial direction.

The first partition wall 114*a* and the seventh partition wall 114*g* may be a boundary that forms an exterior of the antenna 100 and thus may be extended up to a rear of the feeding unit 116. The front of the feeding unit 116 may be a direction in which power or radio wave signals are distributed, and the rear of the feeding unit 116 may be a direction toward the center of the antenna 100 having the fan shape.

The third partition wall 114*c* and the fifth partition wall 114*e* may be implemented to be longer than the second partition wall 114*b*, the fourth partition wall 114*d*, and the sixth partition wall 114*f* and to be shorter than the first partition wall 114*a* and the seventh partition wall 114*g*.

When the antenna 100 has a structure including the above-described partition walls, power $P_1$ supplied from the feeding unit 116 may be distributed into a space between the first partition wall 114*a* and the third partition wall 114*c*, a space between the third partition wall 114*c* and the fifth partition wall 114*e*, and a space between the fifth partition wall 114*e* and the seventh partition wall 114*g*. In this case, distributed power is $P_{12}$, $P_{34}$ and $P_{56}$, respectively.

An angle $\theta_{12}$ formed by the first partition wall 114*a* and the third partition wall 114*c*, an angle $\theta_{34}$ formed by the third partition wall 114*c* and the fifth partition wall 114*e*, and an angle $\theta_{56}$ formed by the fifth partition wall 114*e* and the seventh partition wall 114*g* may be designed to have the same size so that the distributed power $P_{12}$, $P_{34}$ and $P_{56}$ have the same strength.

That is, it may be $\theta_{12}=\theta_{34}=\theta_{56}$ so that $P_{12}=P_{34}=P_{56}$. Also, since supplied power $P_1$ has been distributed into three power values having the same strength, the relationship of $P_1=3P_{12}=3P_{34}=3P_{56}$ may be established.

The power $P_{12}$ distributed into a space between the first partition wall 114*a* and the third partition wall 114*c* may be re-distributed into a space between the first partition wall 114*a* and the second partition wall 114*b* and a space between the second partition wall 114*b* and the third partition wall 114*c*. That is, the power $P_{12}$ may be distributed into the first waveguide 115*a* and the second waveguide 115*b*. In such a case, the distributed power is $P_1$ and $P_2$ respectively.

Power $P_{34}$ distributed into a space between the third partition wall 114*c* and the fifth partition wall 114*e* may be re-distributed into a space between the third partition wall 114*c* and the fourth partition wall 114*d* and a space between the fourth partition wall 114*d* and the fifth partition wall 114*e*. That is, the power $P_{34}$ may be distributed into the third waveguide 115*c* and the fourth waveguide 115*d*. In such a case, the distributed power is $P_3$ and $P_4$ respectively.

Power $P_{56}$ distributed into a space between the fifth partition wall 114*e* and the seventh partition wall 114*g* may be re-distributed into a space between the fifth partition wall 114*e* and the sixth partition wall 114*f* and a space between the sixth partition wall 114*f* and the seventh partition wall 114*g*. That is, the power $P_{56}$ may be distributed into the fifth waveguide 115*e* and the sixth waveguide 115*f*. In such a case, the distributed power is $P_5$ and $P_6$ respectively.

Similarly, an angle $\theta_1$ formed by the first partition wall 114*a* and the second partition wall 114*b*, an angle $\theta_2$ formed by the second partition wall 114*b* and the third partition wall 114*c*, an angle $\theta_3$ formed by the third partition wall 114*c* and the fourth partition wall 114*d*, an angle $\theta_4$ formed by the fourth partition wall 114*d* and the fifth partition wall 114*e*, an angle $\theta_5$ formed by the fifth partition wall 114*e* and the sixth partition wall 114*f*, and an angle $\theta_6$ formed by the sixth partition wall 114*f* and the seventh partition wall 114*g* may be designed to have the same size so that the size of power distributed into each waveguide may be the same. That is, $\theta_{12}=2\theta_1=2\theta_2$, and $\theta_{34}=2\theta_3=2\theta_4$, and $\theta_{56}=2\theta_5=2\theta_6$.

As a result, the relationship of $P_1=3P_{12}=3P_{34}=3P_{56}=6P1=6P_2=6P_3=6P_4=6P_5=6P_6$ may be established. That is, power having the same size may be distributed into each waveguide, and radio wave signals having the same phase and the same amplitude may diverge and radiate through the radiation slots.

Like in the current example, it is possible that when a central angle of the directional antenna 100 is 90 degrees, $\theta_{12}=\theta_{34}=\theta_{56}=30$ degrees, and $\theta_1=\theta_2=\theta_3=\theta_4=\theta_5=\theta_6=15$ degrees.

Meanwhile, distribution of power using the above-described partition wall structure is just an example that may be applied to the antenna 100 and it is obvious that various modified examples in which the stage of power distribution may be subdivided or power may be distributed in six directions at once or the number of waveguides may be less than or larger than 6.

Figure 9:
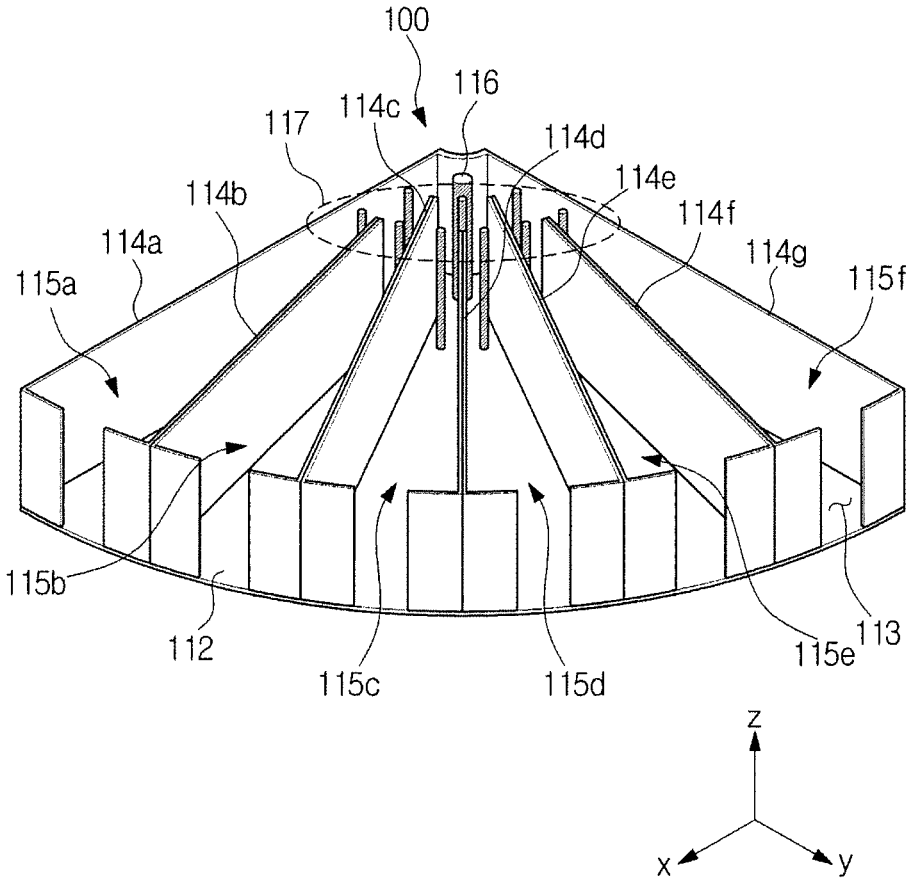
FIGS. 9 and 10 are views illustrating a feeding structure that further includes inductive posts.
Figure 10:
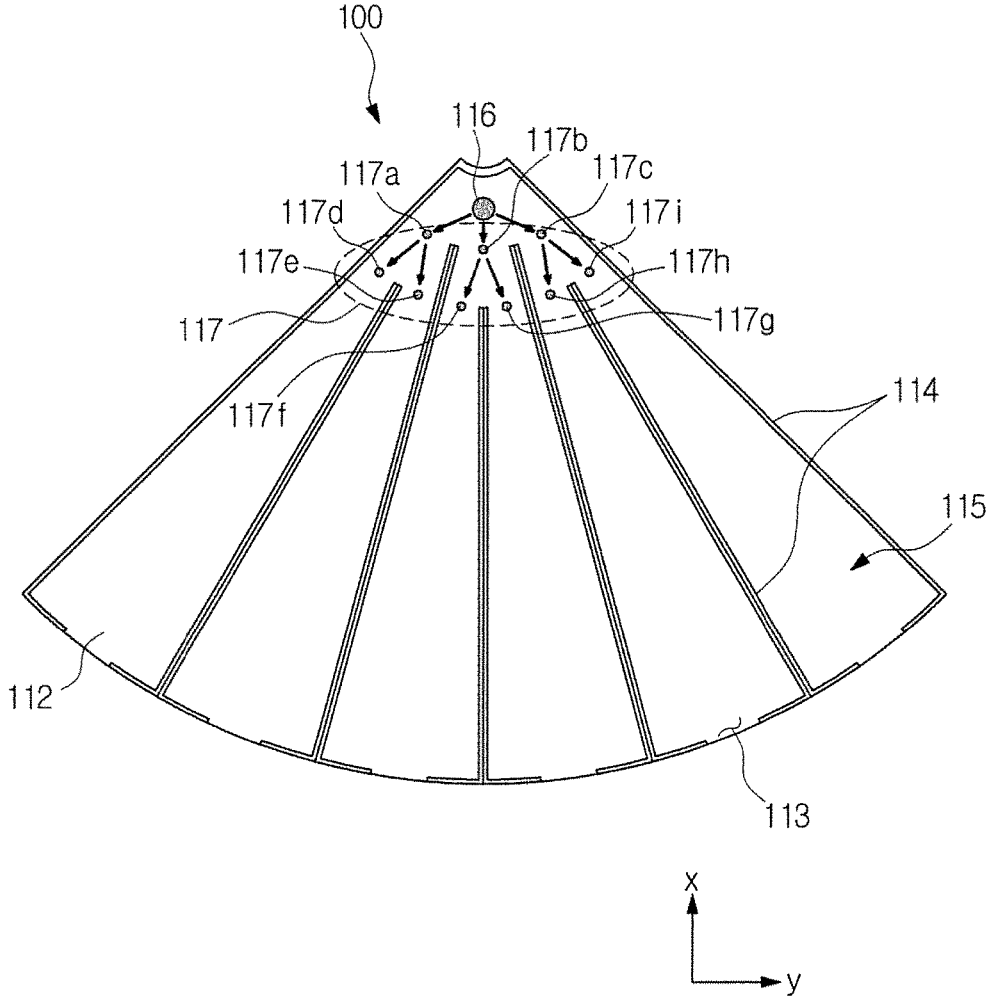

FIGS. 9 and 10 are views illustrating a feeding structure that further includes inductive posts.

Referring to FIGS. 9 and 10, inductive posts 117 may be further included in the antenna 100 so as to improve a return loss. The inductive posts 117 may be implemented with metal pins.

When distribution of power is performed, like in the above-described example, three inductive posts 117*a*, 117*b*, and 117*c* may be firstly disposed in a position nearby the feeding unit 116, behind which six inductive posts 117*d*, 117*e*, 117*f*, 117*g*, 117*h*, and 117*i* that correspond to each waveguide may be disposed.

In detail, the inductive posts 117*a*, 117*b*, and 117*c* may be disposed in a space between the first partition wall 114*a* and the third partition wall 114*c*, a space between the third partition wall 114*c* and the fifth partition wall 114*e*, and a space between the fifth partition wall 114*e* and the seventh partition wall 114*g*, respectively.

The inductive posts 117*d*, 117*e*, 117*f*, 117*g*, 117*h*, and 117*i* may be disposed in a space between the first partition wall 114*a* and the second partition wall 114*b*, a space between the second partition wall 114*b* and the third partition wall 114*c*, a space between the third partition wall 114*c* and the fourth partition wall 114*d*, a space between the fourth partition wall 114*d* and the fifth partition wall 114*e*, a space between the fifth partition wall 114*e* and the sixth partition wall 114*f*, and a space between the sixth partition wall 114*f* and the seventh partition wall 114*g*, respectively.

As described above, the inductive posts may be disposed so that the reflection loss of the radio wave signals diverged into each space may be improved by about 20%.

The inductive posts 117 may be connected up to the upper plate 111 and the lower plate 112, and a difference in inductive capacities may occur due to diameters of the inductive posts 117. Thus, the diameters of the inductive posts 117 may be determined by considering a reflection loss quantity.

In addition, a distance between the inductive posts 117 and the feeding unit 116 may be determined according to a central frequency of the radio wave signals.

In addition, since the height of the feeding unit 116 also affects the reflection loss quantity, the antenna 100 may be designed to have a height at which the reflection loss quantity is minimized. In this case, the height of the feeding unit 116 at which the reflection loss quantity may be minimized may be determined by a simulation, an experiment or a calculation.

In addition, when the inductive posts 117 are disposed, a capacitive component between the upper plate 111 and the lower plate 112 may be reduced so that there is a change in impedance. Thus, the height of the feeding unit 116 may be properly adjusted depending on arrangement of the inductive posts 117.

Figure 11:
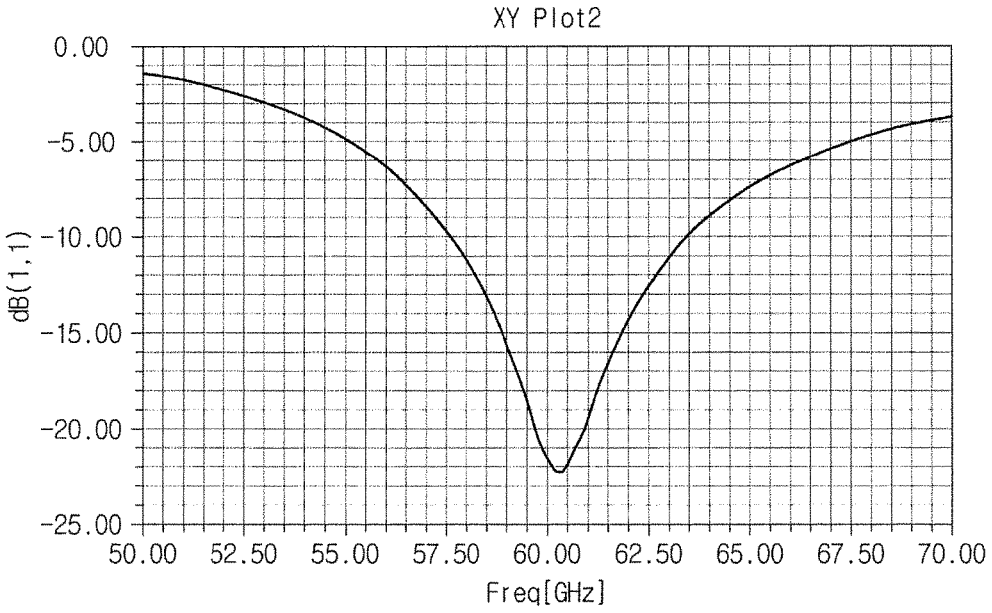
FIG. 11 is a graph showing a return loss of an antenna in accordance with an embodiment of the present disclosure.
Figure 12:
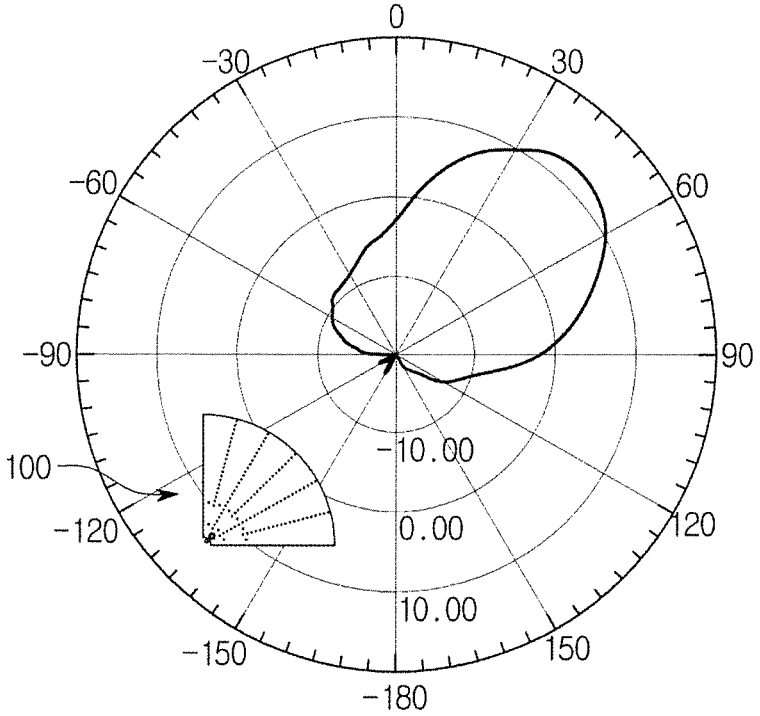
FIG. 12 is a view illustrating a radiation pattern of the antenna in accordance with an embodiment of the present disclosure.

FIG. 11 is a graph showing a reflection loss of the antenna in accordance with an embodiment of the present disclosure, and FIG. 12 is a view illustrating a radiation pattern of the antenna in accordance with an embodiment of the present disclosure.

The example of FIG. 11 shows the result measured using the antenna 100 designed for a 60 GHz band.

Transmission/reception characteristics of the radio wave signals that are radio frequency (RF) signals may be indicated by S parameters. The S parameters may be defined by a ratio of an output voltage with respect to an input voltage in a frequency distribution and may be indicated by a dB scale. Since only input ports exist in the antenna, S11 parameters that indicate values at which voltages are reflected, may be used. The S11 parameters are also referred to as reflection coefficients.

When the S11 parameters descend rapidly in a particular frequency band, reflection of an input voltage may be minimized in a corresponding frequency band. In other words, a resonance phenomenon occurs in the corresponding frequency band so that reception or radiation of signals is optimized. Also, the S11 parameters descending steeply means the reflection characteristics of the signals (are excellent), and a large width of the rapidly-descending graph means the antenna 100 shows a wide band characteristic.

Thus, the antenna 100 used in parameter measurement of FIG. 11 shows excellent reflection characteristics of −20 dB or more in the approximately 60 GHz band. Also, the antenna 100 shows wide band characteristics of 5 GHz or more based on −10 dB.

The reflection loss of the antenna 100 may be freely designed by adjusting the central angle of the fan shape and the number of radiation slots.

The example of FIG. 12 shows a radiation pattern when the central angle of the fan shape of the antenna 100 is implemented at 90 degrees.

Referring to FIG. 12, a side lobe of the radiation pattern of the antenna 100 is very small. This is because signals having the same amplitude and the same phase have been supplied to the plurality of waveguides 115 that constitute the antenna 100.

In addition, the main lobe of the radiation pattern of the antenna 100 is shown in a direction in which the radiation slots of an antenna device are formed. Thus, an excellent directivity of the antenna 100 may be confirmed, and the peak gain is about 12 dBi which is also excellent.

In addition, in the current example, a half power beam width (HPBW) may be about 30 degrees. However, the antenna 100 may be implemented to have a desired size by adjusting the central angle of the fan shape or the number of radiation slots.

Figure 13:
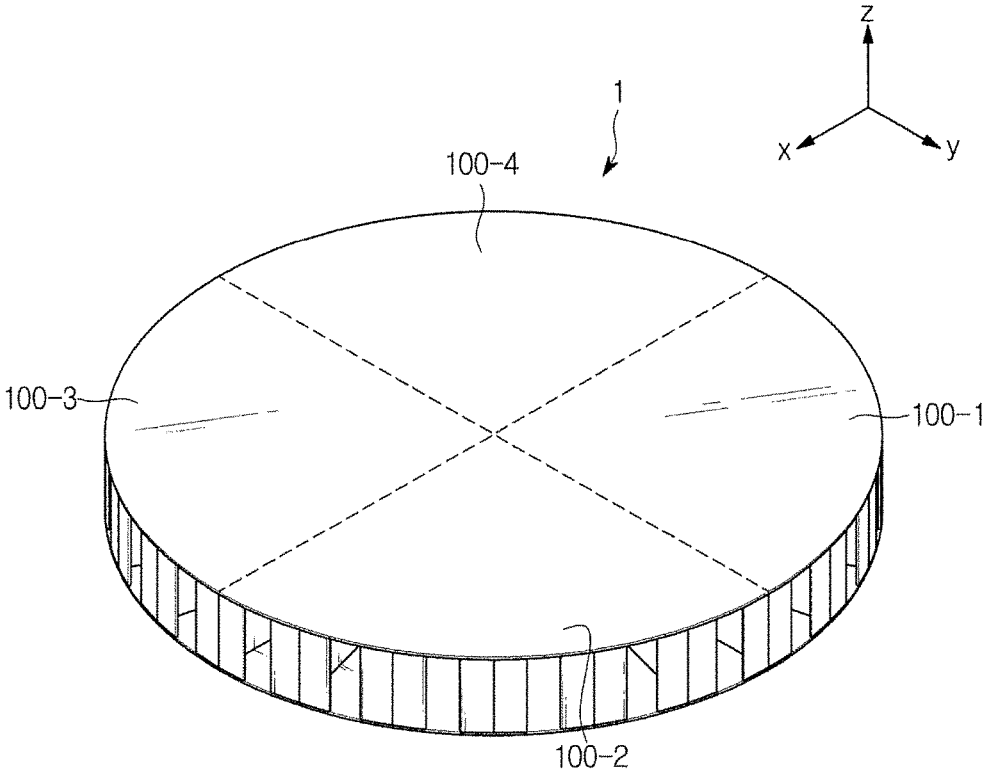
FIGS. 13 through 15 are views of examples in which an antenna in accordance with an embodiment of the present disclosure may be applied.
Figure 14:
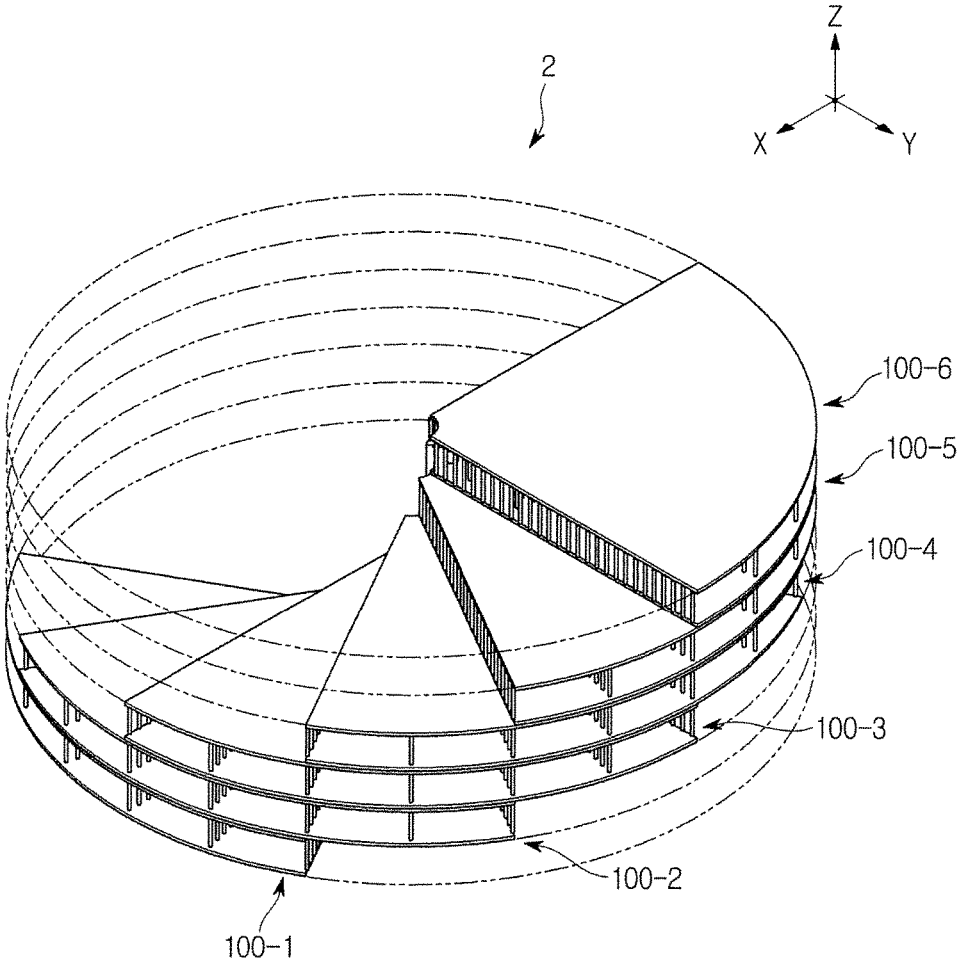
Figure 15:
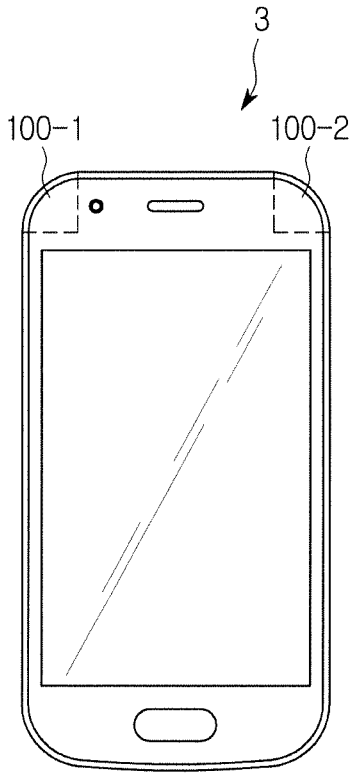

FIGS. 13 through 15 are views of examples in which the antenna in accordance with an embodiment of the present disclosure may be applied.

The antenna 100 in accordance with an embodiment of the present disclosure may have a fan shape, and both a feeding structure and a radiation structure may be disposed in the same plane. Thus, a change in the design of the antenna 100 may be easily made. Thus, an antenna module having various shapes may be implemented using the antenna 100.

Referring to FIG. 13, a plurality of antennas 100-1, 100-2, 100-3, and 100-4 may be arranged in the same plane (xy-plane), and centers of fan shapes of antennas may coincide so that the entire shape of the antenna in the xy-plane may form a circle.

For example, when the central angle of the fan shape of a single antenna is 90 degrees and four single antennas 100-1, 100-2, 100-3, and 100-4 are arranged in a circular shape, an antenna module 1 including a plurality of antennas 100-1, 100-2, 100-3 and 100-4 may be omnidirectional.

When a switch is installed to independently supply power to each antenna, power is selectively supplied to an antenna corresponding to a direction in which communication is to be performed, so that desired directional beam patterns may be formed.

Alternatively, as in the example of FIG. 14, an antenna module 2 having a cylindrical shape in which a plurality of antennas 100-1, 100-2, 100-3, 100-4, 100-5, and 100-6 are stacked in a y-axis direction may be implemented.

The plurality of antennas 100-1, 100-2, 100-3, 100-4, 100-5, and 100-6 are not stacked in a line in a z-axis direction but are shifted by a predetermined angle and are stacked. Each antenna is shifted by a predetermined angle so that a radiation direction of the antenna module 2 or a direction of beam patterns may be adjusted in various ways.

For example, when a first antenna 100-1, a second antenna 100-2, a third antenna 100-3, a fourth antenna 100-4, a fifth antenna 100-5, and a sixth antenna 100-6 are sequentially stacked from the bottom, the second antenna 100-2 may be shifted by 30 degrees in the counterclockwise direction from the first antenna 100-1 about a center C of the antenna module 2 in an xy-plane, and the third antenna 100-3 may be shifted by 30 degrees in the counterclockwise direction from the second antenna 100-2, and the fourth antenna 100-4 may be shifted by 30 degrees in the counterclockwise direction from the third antenna 100-3, and the fifth antenna 100-5 may be shifted by 30 degrees in the counterclockwise direction from the fourth antenna 100-4 and the sixth antenna 100-6 may be shifted by 30 degrees in the counterclockwise direction from the fifth antenna 100-5.

When each of antennas 100-1, 100-2, 100-3, 100-4, 100-5, and 100-6 has a radiation range of 90 degrees and power may not be independently supplied to the antennas 100-1, 100-2, 100-3, 100-4, 100-5, and 100-6, the antenna module 2 may cover a range of approximately 240 degrees and may selectively radiate radio wave signals in a desired direction within the 240 degree range. Also, the coverage of the antenna module 2 may be adjusted by changing a design of a radiation range of a single antenna, a shift angle between single antennas, and the number of antennas in various ways.

In addition, like in the examples of FIGS. 13 and 14, when a plurality of antennas are arranged or stacked to constitute one antenna module 1 or 2, the radiation angle of each antenna, i.e., the central angle of the fan shape or the number of radiation slots may be implemented to be the same or different.

Meanwhile, a single antenna 100 in accordance with an embodiment of the present disclosure may be built in a communication device. Alternatively, as described above, the antenna module 1 or 2 configured in such a way that the plurality of antenna 100 are arranged or stacked may also be built in the communication device.

In the former case, like in the example of FIG. 15, antennas 100-1 and 100-2 may be built in a mobile device 3 such as a smartphone. The antennas 100-1 and 100-2 may be easily installed at an outer portion of the mobile device 3 due to the fan shape.

In particular, an antenna module including the antenna 100 in accordance with an embodiment of the present disclosure or a plurality of antennas is built in a vehicle and enables communication between vehicles or communication between a vehicle and another communication device or a server. Hereinafter, an embodiment of the vehicle including the antenna 100 will be described.

Figure 16:
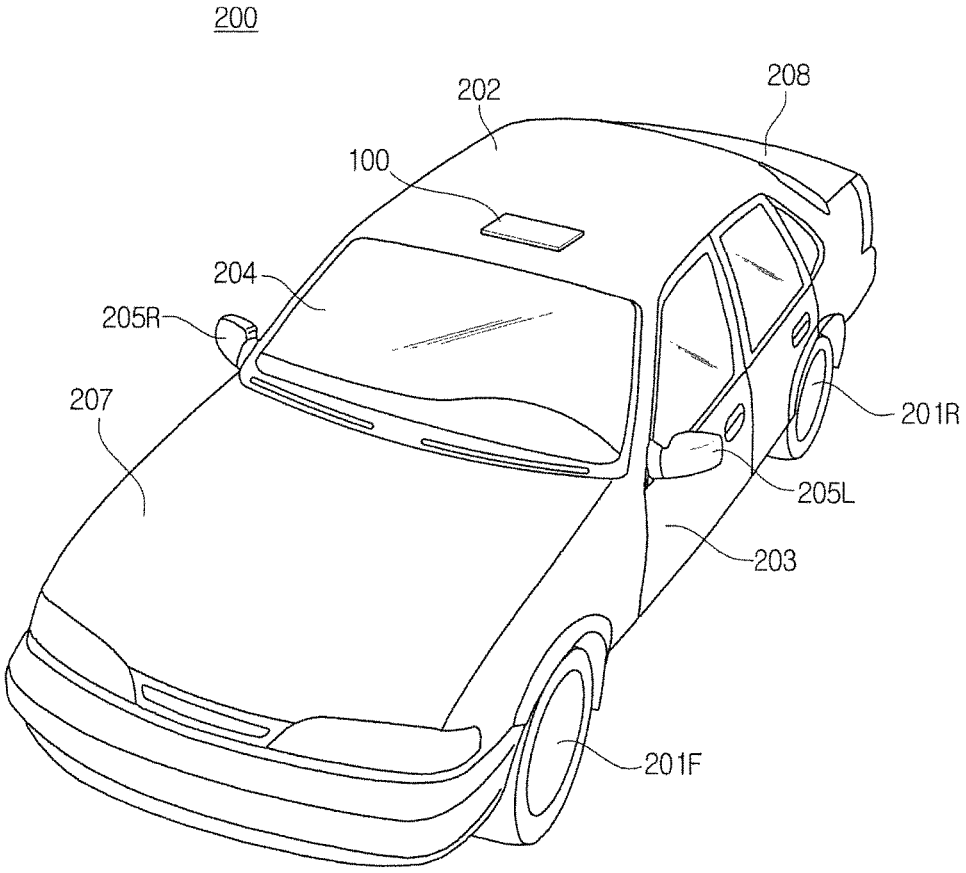
FIGS. 16 and 17 are views illustrating an exterior of a vehicle in accordance with an embodiment of the present disclosure.
Figure 17:
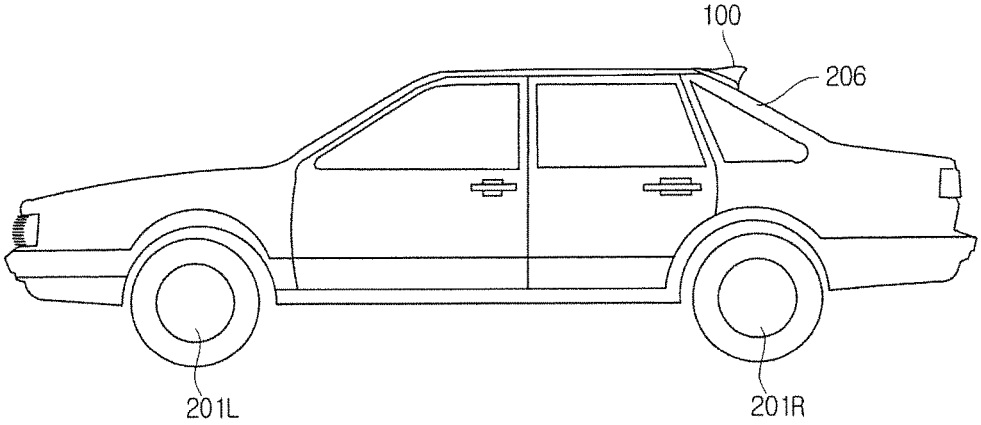

FIGS. 16 and 17 are views illustrating an exterior of a vehicle in accordance with an embodiment of the present disclosure.

Referring to FIGS. 16 and 17, a vehicle 200 in accordance with an embodiment of the present disclosure includes wheels 201F and 201R that allow the vehicle 200 to be moved, a body 202 that forms an exterior of the vehicle 200, a driving device (not shown) that rotates the wheels 201F and 201R, doors 203 that shield an interior of the vehicle 200 from the outside, front glass 204 that provides a field of vision in the front direction of the vehicle 200 to a driver in the interior of the vehicle 200, and side mirrors 205L and 205R that provide a field of vision in the rear direction of the vehicle 200 to the driver.

The wheels 201F and 201R include a front wheel 201F disposed in front of the vehicle 200 and a rear wheel 201R disposed behind the vehicle 200. The driving device disposed in an engine hood 207 provides a rotational force to the front wheel 201F or the rear wheel 201R so that the vehicle 200 may be moved in a forward or backward direction.

An engine that generates a rotational force by combusting a fossil fuel or a motor that generates a rotational force by power supplied from an electric condenser (not shown) may be employed as the driving device.

The doors 203 are pivotally disposed at left and right sides of the body 202, allow the driver to enter the interior of the vehicle 200 when the door 203 is open, and allow the interior of the vehicle 200 to be shielded from the outside when the door 203 are closed.

The front glass 204 is disposed in front of the body 202, allows the driver inside the vehicle 200 to obtain visual information regarding the front of the vehicle 200, and is also referred to as windshield glass.

In addition, the side mirrors 205L and 205R include a left side mirror 205L disposed at the left side of the body 202 and a right side mirror 205R disposed at the right side of the body 202 and allow the driver inside the vehicle 200 to obtain visual information regarding sides and rear of the body 202.

The antenna 100 may be built outside the vehicle 200. Since the antenna 100 may be implemented to have an ultra-small size and a low profile, like in the example of FIG. 16, the antenna 100 may be built on top of a roof or the engine hood 207, and like in the example of FIG. 17, the antenna 100 may be implemented as a one body type together with a shark antenna built at an upper side of the rear glass 206. For example, when the antenna 100 is designed based on a 60 Hz band according to the above-described structure of FIG. 4, the height of the antenna 100 may be implemented as 1.0 mm, and a radius of the fan shape may be implemented as 6 mm.

In addition, two or more antenna 100 may also be built in the vehicle 200. For example, the antenna 100 that covers the front may be built on the engine hood 207, and the antenna 100 that covers the rear may be built in a trunk 208 or the shark antenna.

The position of the antenna 100 or the number of antennas 100 is not limited, and a suitable position of the antenna 100 and the number of antennas 100 may be determined with a consideration given to the use of the antenna 100, design of the vehicle 200, and linear propagation characteristic.

In addition, the single antenna 100 may be built in the vehicle 200, or the antenna module 1 or 2 in which a plurality of antennas 100 are arranged or stacked may also be built in the vehicle 200. In the latter case, a switch that is capable of independently and selectively supplying power to each antenna may be included in the antenna module 1 or 2.

Figure 18:
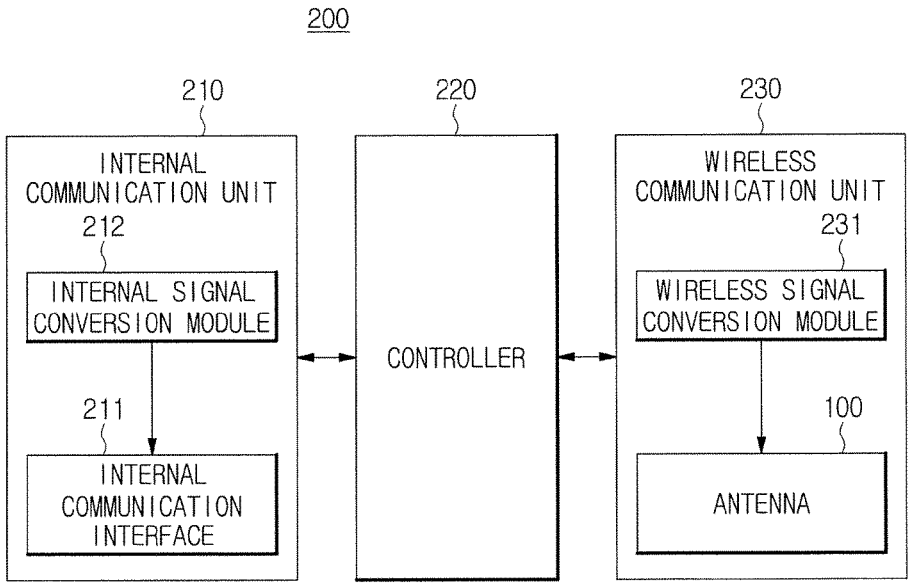
FIG. 18 is a control block diagram of the vehicle in accordance with an embodiment of the present disclosure.

FIG. 18 is a control block diagram of the vehicle in accordance with an embodiment of the present disclosure. The control block diagram of FIG. 18 illustrates a configuration relating to communication of a vehicle, and configurations relating to other operations such as driving of the vehicle and internal environment controls are omitted. Thus, that an element is not shown in the control block diagram of FIG. 18 does not indicate the element is excluded as elements of the vehicle 200.

Referring to FIG. 18, the vehicle 200 may include an internal communication unit 210 that communicates with various electronic devices inside the vehicle 200 through a vehicle communication network inside the vehicle 200, a wireless communication unit 230 that communicates with a terminal device outside the vehicle 200, a base station, a server or another vehicle, and a controller 220 that controls the internal communication unit 210 and the wireless communication unit 230.

The internal communication unit 210 may include an internal communication interface 211 connected to the vehicle communication network and an internal signal conversion module 212 that modulates/demodulates signals.

The internal communication interface 211 may receive communication signals transmitted from various electronic devices inside the vehicle 200 through the vehicle communication network and may transmit communication signals to various electronic devices inside the vehicle 200 through the vehicle communication network. Here, the communication signals mean signals transmitted/received through the vehicle communication network.

The internal communication interface 211 may include communication ports and a transceiver that transmits/receives signals.

The internal signal conversion module 212 may demodulate the communication signals received through the internal communication interface 211 into control signals and may demodulate the control signals output from the controller 220 into analog communication signals to be transmitted through the internal communication interface 211.

The internal signal conversion module 212 may modulate the control signals output by the controller 220 into communication signals based on a communication protocol of a vehicle network and demodulates the communication signals based on the communication protocol of the vehicle network into control signals that may be recognized by the controller 220.

The internal signal conversion module 212 may include a memory for storing a program and data for performing modulation/demodulation of the communication signals and a processor for performing modulation/demodulation of the communication signals according to the program and data stored in the memory.

The controller 220 controls operations of the internal signal conversion module 212 and the communication interface 211. For example, when the communication signals are received, the controller 220 may determine whether a communication interface is occupied by another electronic device through the communication interface 211, and if the communication network is empty, the controller 220 may control the internal communication interface 311 and the internal signal conversion module 212 so as to transmit the communication signals. In addition, when the communication signals are received, the controller 220 may control the internal communication interface 211 and the internal signal conversion module 212 so as to demodulate the communication signals received through the communication interface 211.

The controller 220 may include a memory for storing a program and data for controlling the internal signal conversion module 212 and the communication interface 211 and a processor for generating control signals by executing the program stored in the memory and processing the data.

In addition, the controller 220 may also be included in an electronic control unit (ECU) for performing general control on the vehicle 200 or may be disposed separately from the ECU. Also, the controller 220 may share the processor included in the internal communication unit 210 or the wireless communication unit 230.

The wireless communication unit 330 may include a transceiver 331 that modulates/demodulates signals and an antenna 100 that radiates radio wave signals to the outside and/or receives the radio wave signals from the outside.

The transceiver 231 may include a receiver that demodulates the radio wave signals received by the antenna 100 and a transmitter that modulates the control signals output from the controller 220 into radio wave signals to be transmitted to the outside.

The radio wave signals may send signals by a high-frequency (for example, about 28 GHz band in case of a 5G communication method) carrier wave. To this end, the transceiver 231 may modulate the high-frequency carrier wave according to the control signals output from the controller 220 to generate transmission signals and may demodulate the signals received by the antenna 100 to restore reception signals.

For example, the transceiver 231 may include an encoder (ENC), a modulator (MOD), a multiple input multiple output (MIMO) encoder, a pre-coder, an inverse fast Fourier transformer (IFFT), a parallel to serial converter (P/S), a cyclic prefix (CP) inserter, a digital to analog converter (DAC) and a frequency converter so as to generate transmission signals.

L control signals may be input to the MIMO encoder through the ENC and the MOD. M streams output from the MIMO encoder are pre-coded by a pre-coder and are converted into N pre-coded signals. The pre-coded signals are output as analog signals through the IFFT, the P/S, the CP inserter, and the DAC. The analog signals output from the DAC are converted into an RF band by using the frequency converter and are supplied to the antenna 100.

The transceiver 231 may include a memory for storing a program and data for performing modulation/demodulation of communication signals and a processor for performing modulation/demodulation of the communication signals according to the program and the data stored in the memory.

However, the configuration of the transceiver 231 described above is just an example, and the transceiver 231 may also be implemented to have a configuration other than the example.

The vehicle 200 may communicate with an external server or a control center through the antenna 100 and may transmit and receive real-time traffic information, accident information, and information regarding a status of a vehicle. In addition, the vehicle 200 may transmit and receive sensor information measured by a sensor disposed in each vehicle through communication with another vehicle, may adaptively cope with road situations, or may collect information relating to an accident when an accident occurs. Here, the sensor disposed in the vehicle 200 may include at least one selected from the group consisting of an image sensor, an acceleration sensor, a collision sensor, a gyrosensor, a proximity sensor, a steering angle sensor, and a vehicle speed sensor.

When a plurality of antennas 100 are disposed in the vehicle 200 and power can be selectively supplied to each antenna 100, the controller 220 may determine a communication object direction and may supply power selectively to the antenna 100 corresponding to the determined direction.

Although the above embodiments have been described by restrictive embodiments and the drawings, various correction and modification may be made by one of ordinary skill in the art from the above description. For example, even though described techniques are performed in an order different from the described methods and/or elements of the described system, structure, device, and circuit are mixed or combined in a shape different from the described methods, or the elements are replaced or substituted with other elements or equivalents, a proper result may still be achieved.

Therefore, other implementations, other embodiments, and equivalents of the claims belong to the scope of the claims that will be described later.

According to an antenna in accordance with an aspect of the present disclosure and a vehicle having the same, a simple structure in which a feeding unit and a radiation unit are disposed in the same plane so that design of an additional feeding unit is not required can be provided.

In addition, a radiation angle can be adjusted allowing a design of the antenna to be easily changed according to a use of the antenna.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An antenna comprising:

an upper plate having a fan shape;

a lower plate having a shape corresponding to the upper plate;

a feeding unit disposed between the upper plate and the lower plate at a center of the fan shape;

at least one waveguide formed between the upper plate and the lower plate for propagating signals supplied from the feeding unit; and at least one radiation slot formed in an arc of the fan shape for radiating the signals propagated by the at least one waveguide to the outside, wherein the at least one waveguide is partitioned by a first partition wall and a second partition wall disposed between the upper plate and the lower plate, and the first partition wall has a length different from that of the second partition wall.

2. The antenna according to claim 1, wherein each of the first partition wall and the second partition wall has a plate shape.

3. The antenna according to claim 1, wherein the first partition wall and the second partition wall are formed by a plurality of pins adjacently disposed at a critical distance or less.

4. The antenna according to claim 3, wherein the plurality of pins are inserted into the upper plate and the lower plate.

5. The antenna according to claim 1, wherein a plurality of waveguides are provided, and the plurality of waveguides distribute signals supplied from the feeding unit with the same phase and the same amplitude.

6. The antenna according to claim 5, further comprising a plurality of inductive posts disposed at inlets of the plurality of waveguides to which the signals supplied from the feeding unit are input.

7. The antenna according to claim 4, wherein the upper plate and the lower plate comprise printed circuit boards (PCBs).

8. The antenna according to claim 2, wherein the upper plate, the lower plate, and the first and second partition walls comprise at least one selected from the group consisting of copper, iron, aluminum, silver, nickel, and stainless steel.

9. The antenna according to claim 5, wherein each of the first partition wall and the second partition wall has the same angle formed by neighboring partition walls.

10. A vehicle comprising:

at least one antenna; and a transceiver for modulating signals to be supplied to the at least one antenna and for demodulating the signals received by the at least one antenna, wherein the at least one antenna comprises:

an upper plate having a fan shape;

a lower plate having a shape corresponding to the upper plate;

a feeding unit disposed between the upper plate and the lower plate at a center of the fan shape;

at least one waveguide formed between the upper plate and the lower plate and for propagating signals supplied from the feeding unit; and at least one radiation slot formed in an arc of the fan shape and for radiating the signals propagated by the at least one waveguide to the outside, wherein the at least one waveguide is partitioned by a first partition wall and a second partition wall disposed between the upper plate and the lower plate, and the first partition wall has a length different from that of the second partition wall.

11. The vehicle according to claim 10, wherein each of the first partition wall and the second partition wall has a plate shape, or the partition walls are formed by a plurality of pins adjacently disposed at a critical distance or less.

12. The vehicle according to claim 11, wherein the plurality of pins are inserted into the upper plate and the lower plate.

13. The vehicle according to claim 10, wherein a plurality of waveguides are provided, and the plurality of waveguides distribute signals supplied from the feeding unit with the same phase and the same amplitude.

14. The vehicle according to claim 11, wherein the upper plate and the lower plate comprise printed circuit boards (PCBs).

15. The vehicle according to claim 11, wherein the upper plate, the lower plate, and the first and second partition walls comprise at least one selected from the group consisting of copper, iron, aluminum, silver, nickel, and stainless steel.

16. The vehicle according to claim 13, wherein each of the first partition wall and the second partition wall has the same angle formed by neighboring partition walls.

* * * * *